US005597681A

United States Patent [19]

Anderson et al.

[11] Patent Number: 5,597,681

[45] **Date of Patent: * Jan. 28, 1997**

[54] IMAGING ELEMENT COMPRISING AN ELECTRICALLY-CONDUCTIVE LAYER AND A PROTECTIVE OVERCOAT LAYER CONTAINING SOLVENT-DISPERSIBLE POLYMER PARTICLES

[75] Inventors: Charles C. Anderson; Yongcai Wang, both of Penfield; Mario D. DeLaura, Hamlin; James L. Bello, Rochester, all of N.Y.

[73] Assignee: Eastman Kodak Company, Rochester, N.Y.

[ * ] Notice: The term of this patent shall not extend beyond the expiration date of Pat. No. 5,597,680.

[21] Appl. No.: 567,789

[22] Filed: Dec. 5, 1995

[51] Int. Cl.[6] ..... G03C 1/76

[52] U.S. Cl. ..... 430/523; 430/527; 430/531; 430/536; 430/537; 430/539; 430/524; 430/525

[58] Field of Search ..... 430/523, 527, 430/531, 536, 537, 539, 524, 525

[56] References Cited

U.S. PATENT DOCUMENTS

| | | | |
|---|---|---|---|
| 4,612,279 | 9/1986 | Steklenski et al. | 430/536 |
| 4,714,671 | 12/1987 | Helling et al. | 430/537 |
| 4,914,012 | 4/1990 | Kawai | 430/536 |
| 5,066,572 | 11/1991 | O'Connor et al. | 430/531 |
| 5,248,558 | 9/1993 | Bagchi et al. | 430/537 |

*Primary Examiner*—Geraldine Letscher
*Attorney, Agent, or Firm*—Alfred P. Lorenzo

[57] ABSTRACT

Imaging elements, such as photographic films and papers, are comprised of a support, an image-forming layer, an electrically-conductive layer and a protective overcoat layer that overlies the electrically-conductive layer. The protective overcoat layer is coated from a dispersion of core/shell polymer particles in a liquid organic medium, the polymer particles comprising a core portion which is insoluble in the organic medium and a shell portion which has an affinity for both the core portion and the organic medium.

24 Claims, No Drawings

IMAGING ELEMENT COMPRISING AN ELECTRICALLY-CONDUCTIVE LAYER AND A PROTECTIVE OVERCOAT LAYER CONTAINING SOLVENT-DISPERSIBLE POLYMER PARTICLES

CROSS-REFERENCE TO RELATED APPLICATIONS

Copending commonly-assigned U.S. patent application Ser. No. 567,788, filed Dec. 5, 1995, "Imaging Element Comprising An Auxiliary Layer Containing Solvent-Dispersible Polymer Particles" by Yongcai Wang, Charles C. Anderson, James L. Bello and Mario D. DeLaura describes imaging elements comprised of a support, an image-forming layer and an auxiliary layer, such as for example a subbing layer, backing layer, interlayer, overcoat layer, receiving layer, barrier layer, stripping layer, mordanting layer, scavenger layer, antikinking layer or transparent magnetic layer, which is coated from a dispersion in a liquid organic medium of core/shell polymer particles comprising a core portion which is insoluble in the organic medium and a shell portion which has an affinity for both the core portion and the organic medium.

FIELD OF THE INVENTION

This invention relates in general to imaging elements, such as photographic films and papers, and in particular to imaging elements comprising a support, an image-forming layer, an electrically-conductive layer and a protective overcoat layer that overlies the electrically-conductive layer. More specifically, this invention relates to such imaging elements having an improved overcoat layer exhibiting superior chemical, physical and manufacturability characteristics.

BACKGROUND OF THE INVENTION

In the photographic industry, the need to provide photographic film and paper with antistatic protection has long been recognized. Such protection is important since the accumulation of static charges as a result of various factors in the manufacture, finishing, and use of photographic elements is a serious problem in the photographic art. Accumulation of static charges can result in fog patterns in photographic emulsions, various coating imperfections such as mottle patterns and repellency spots, dirt and dust attraction which may result in the formation of "pinholes" in processed films, and a variety of handling and conveyance problems.

To overcome the problem of accumulation of static charges it is conventional practice to provide an antistatic layer (i.e., an electrically-conductive layer) in photographic elements. A very wide variety of antistatic layers are known for use in photographic elements. For example, an antistatic layer comprising an alkali metal salt of a copolymer of styrene and styrylundecanoic acid is disclosed in U.S. Pat. No. 3,033,679. Photographic films having a metal halide, such as sodium chloride or potassium chloride, as the conducting material, in a hardened polyvinyl alcohol binder are described in U.S. Pat. No. 3,437,484. In U.S. Pat. No. 3,525,621, the antistatic layer is comprised of colloidal silica and an organic antistatic agent, such as an alkali metal salt of an alkylaryl polyether sulfonate, an alkali metal salt of an arylsulfonic acid, or an alkali metal salt of a polymeric carboxylic acid. An antistatic layer comprised of an anionic film forming polyelectrolyte, colloidal silica and a polyalkylene oxide is disclosed in U.S. Pat. No. 3,630,740. In U.S. Pat. No. 3,681,070, an antistatic layer is described in which the antistatic agent is a copolymer of styrene and styrene sulfonic acid. U.S. Pat. No. 4,542,095 describes antistatic compositions comprising a binder, a nonionic surface-active polymer having polymerized alkylene oxide monomers and an alkali metal salt. In U.S. Pat. No. 4,916,011, an antistatic layer comprising a styrene sulfonate-maleic acid copolymer, a latex binder, and an alkyl-substituted trifunctional aziridine crosslinking agent is disclosed. An antistatic layer comprising a vanadium pentoxide colliodal gel is described in U.S. Pat. No. 4,203,769. U.S. Pat. Nos. 4,237,194, 4,308,332, and 4,526,706 describe antistats based on polyaniline salt-containing layers. Crosslinked vinylbenzyl quaternary ammonium polymer antistatic layers are described in U.S. Pat. No. 4,070,189.

Frequently, the chemicals in a photographic processing solution are capable of reacting with or solubilizing the conductive compounds in an antistatic layer, thus causing a diminution or complete loss of the desired antistatic properties. To overcome this problem, antistatic layers are often overcoated with a protective layer to chemically isolate the antistatic layer and in the case of backside (that is, the side opposite to the photographic emulsion layer) antistatic layers the protective layer may also serve to provide scratch and abrasion resistance.

Typically, the protective layer is a glassy polymer with a glass transition temperature (Tg) of 70° C. or higher that is applied from organic solvent-based coating solutions. For example, in the aforementioned U.S. Pat. No. 4,203,769 the vanadium pentoxide antistatic layer may be overcoated with a cellulosic protective layer applied from an organic solvent. U.S. Pat. Nos. 4,612,279 and 4,735,976 describe organic solvent-applied protective overcoats for antistatic layers comprising a blend of cellulose nitrate and a copolymer containing acrylic acid or methacrylic acid.

To apply the protective layer, the glassy polymers are normally dissolved in a solvent at very low solids to ensure low coating solution viscosities for good coatability at high coating speeds. Coating techniques employed include one to three layer extrusion dies (commonly referred to as X-hoppers), air knife, roller coating devices, meyer rods, knife over roll, and so on.

For coating solutions comprising soluble polymers of reasonably high molecular weights, for example, larger than 50,000, the solution viscosity is a strong function of polymer concentration. For example, Elvacite 2041, a methyl methacrylate polymer sold by E. I. DuPont de Nemours and Co., has been described in the photographic art to form scratch protective layers for photographic materials. The polymer is normally dissolved in an organic solvent such as methylene chloride to form a clear solution. At concentrations above, for example, 4 to 5 wt %, the Elvacite 2041 solution viscosity is at least 20 cps at ambient temperature. Such viscosity values are too high for coating applications commonly used in photographic support manufacture, for example, roll coater and skim pan air-knife coating techniques, which require a coating solution viscosity in the range of from one to a few centipoises. Therefore, photographic manufacturers have to keep the solids below 3 wt % for low solution viscosities and good coatability at high coating speeds.

Polymer solutions of low solids are useful for applications where low dry coating coverages (<500 mg/m$^2$) can meet the requirements of physical and mechanical properties of an imaging system. More advanced imaging applications need higher dry coating coverages for better physical and mechanical properties. To obtain high dry coating coverages, more coating solution per unit area (wet coverage) has to be applied by using low viscosity/low solids polymer solutions since high viscosity/high solids polymer solutions cannot be coated at low wet coverages at high coating speeds (some coating methods may allow one to coat high viscosity polymer solutions at high wet coverages, but they still suffer from the disadvantages mentioned below). In general, higher wet coverages mean more solvent recovery and higher cost for drying. Furthermore, due to both manufacturing limitations and requirements of an imaging element for other physical and mechanical properties, the wet coverages cannot be increased under certain conditions and for certain applications. For example, high coating wet coverages and the high levels of solvent retained in the film support as a result of these high wet coverages may have a big impact on both dimensional stability and sensitometric properties of an imaging element. One may use resins of low molecular weight to lower the solution viscosity; however, the resultant dry coatings may not have adequate physical and mechanical properties.

Alternative approaches employing low viscosity, dispersed polymer particle-containing coating compositions have been described for paint and automotive coating industries. The use of such compositions in photographic applications has not been disclosed. For example, U.S. Pat. No. 4,336,177 describes a solvent coating composition comprising non-aqueous dispersible composite polymer particles larger than 0.1 mm. The particle has a core with a glass transition temperature (Tg) of about 10 degrees C. less than the polymerization reaction temperature. The particles are stabilized by block or grafting copolymers and can be transferred directly from aqueous medium to a non-aqueous medium. U.S. Pat. No. 4,829,127 describes a coating composition comprising composite resin particles. Such particles are prepared by solution polymerization techniques in reaction vessels containing initiator, solvent, polymerizable monomers, and crosslinked particles. U.S. Pat. No. 3,929,693 describes a coating composition comprising a solution polymer and polymer particles, where the polymer particles have a crosslinked rubbery core below 60° C. and a grafted shell having molecular weight of 1,000 to 150,000. Reportedly, such coating compositions are more stable toward premature separation and flocculation. U.S. Pat. No. 3,880,796 describes a coating compostion comprising thermosetting polymer particles containing insoluble microgel particles having a particle size of from 1 to 10 μm. U.S. Pat. No. 4,147,688 describes a dispersion polymerization process of making crosslinked acrylic polymer microparticles having a particle size of from 0.1 to 10 μm. U.S. Pat. No. 4,025,474 describes a coating composition comprising a hydroxyfunctional oil-modified or oil-free polyester resin, aminoplast resin, and 2 to 50% of crosslinked polymer microparticles (0.1 to 10 μm) made by a dispersion polymerization process. U.S. Pat. No. 4,115,472 describes a polyurethane coating composition comprising an ungelled hydroxy-containing urethane reaction product and insoluble crosslinked acrylic polymer microparticles (0.1 to 10 μm) made by a dispersion polymerization process. Such coatings are reportedly useful for automotive industries.

There are significant differences in designing coating compositions for photographic applications from those for paint and automotive coating industries. The coating techniques and coating delivery systems are different so that they need different coating theologies. The drying time in exterior and interior paint and architectural coating applications is on the order of hours and days, and in the automobile industry on the order of 10 to 30 min. However, in the photographic support manufacturing process the drying time for coatings is typically on the order of seconds. Often the drying time for solvent-borne coatings is as brief as 10–30 seconds for high speed coating applications. These differences put additional stringencies on the coating composition for photographic materials. For example, the coating viscosity needs to be on the order of less than 10 cps, and more often less that 5 cps, instead of on the order of one hundred to several thousand cps as in other coating industries. A typical dry coating thickness for photographic materials is on the order of less than 2 μm, and more often less than 1 μm. The film formation and film quality are especially critical. The tolerance on defects caused by polymer gel slugs, gelled particles, dust, and dirt is extremely low. This requires special precautions in delivery processes. The coating solutions need to be very stable toward, for example, high speed filtration and high shear.

Aqueous coating compositions comprising water dispersible polymer particles have been reported to be useful for some photographic applications. For example, they have been used as "priming" or subbing layers on film support to act as adhesion promotion layers for photographic emulsion layers, and used as barrier layers over, for example, a vanadium pentoxide antistatic subbing layer to prevent the loss of antistatic properties after film processing as described in U.S. Pat. No. 5,006,451. While these coating compositions are attractive from environmental considerations, the slow evaporation rate of water coupled with its extremely high heat of vaporization causes drying problems which are either not normally encountered or can be easily overcome in solvent-borne systems. Therefore, for manufacturing processes with conventional organic solvent drying capacity, the use of water-borne coating compositions often leads to very unsatisfactory results. In addition, challenges still exist to develop water-based coatings that provide similar physical and chemical properties in the dried film that can be obtained with organic solvent-based coatings.

Aqueous coating compositions comprising core/shell polymer particles have been disclosed for photographic materials as ferrotyping resistance layers in U.S. Pat. No. 4,497,917, where the polymers are described as having a core with a Tg of greater than 70° C. and a shell with a Tg from 25° to 60° C., and as subbing layers in U.S. Pat. No. 4,977,071 and US Reg. No. H1016, where the polymers are described as a vinylidene chloride copolymer core/shell latex. U.S. Pat. No. 5,366,855, issued Nov. 22, 1994, describes for imaging elements a coalesced layer comprising film-forming colloidal polymer particles and non-film forming colloidal polymer particles. This layer is coated from an aqueous medium and contains polymer particles of both high and low glass transition temperatures. Other aqueous coating compositions that comprise core/shell polymer particles are described in U.S. Pat. Nos. 4,683,269, 4,613,633, 4,567,099, 4,478,974, and 4,134,872. The use of these compositions in photographic films has not been disclosed.

It can be seen that various approaches have been attempted to obtain useful organic solvent-based coating compositions with low viscosity and high percent solids. However, the aforementioned prior art references are deficient with regard to simultaneously satisfying all the physical, chemical, and manufacturing requirements for a solvent-borne, protective coating for antistatic layers that are useful for photographic elements. The present invention provides a coating composition which meets all of these requirements while avoiding the problems and limitations of the prior art.

SUMMARY OF THE INVENTION

In accordance with this invention, an imaging element for use in an image-forming process is comprised of a support, an image-forming layer, an electrically-conductive layer and a protective overcoat layer that overlies the electrically-conductive layer. The protective overcoat layer is coated from a dispersion of polymer particles in a liquid organic medium, the polymer particles comprising a core portion which is insoluble in the organic medium and a shell portion which has an affinity for both the core portion and the organic medium.

The polymer particles employed to form the protective overcoat layer of this invention can be described as "solvent-dispersible polymer particles" with the term "solvent", as used herein, referring to any liquid organic medium in which the polymer particles can be dispersed. Coating compositions containing such solvent-dispersible polymer particles exhibit unique coating rheologies and form high quality films with excellent physical and mechanical properties that prevent the loss of antistatic properties during photographic processing.

DETAILED DESCRIPTION OF THE INVENTION

The imaging elements of this invention can be of many different types depending on the particular use for which they are intended. Such elements include, for example, photographic, electrophotographic, electrostatographic, photothermographic, migration, electrothermographic, dielectric recording and thermal-dye-transfer imaging elements. Photographic elements can comprise various polymeric films, papers, glass, and the like, but both acetate and polyester supports well known in the art are preferred. The thickness of the support is not critical. Support thickness of 2 to 10 mil (0.06–0.30 millimeters) can be used. The supports typically employ an undercoat or subbing layer well known in the art that comprises, for example, for polyester support a vinylidene chloride/methyl acrylate/itaconic acid terpolymer or vinylidene chloride/acrylonitrile/acrylic acid terpolymer.

Details with respect to the composition and function of a wide variety of different imaging elements are provided in U.S. Pat. No. 5,340,676 and references described therein. The present invention can be effectively employed in conjunction with any of the imaging elements described in the '676 patent.

The protective overcoats of the present invention can be successfully employed with a variety of antistatic layers well known in the art. Particularly useful antistatic layers include those described in aforementioned U.S. Pat. Nos. 4,070,189, 4,203,769, 4,237,194, 4,308,332, and 4,526,706, for example.

The antistatic layer described in U.S. Pat. No. 4,203,769 is prepared by coating an aqueous colloidal solution of vanadium pentoxide. Preferably, the vanadium pentoxide is doped with silver. A polymer binder, such as a vinylidene chloride-containing terpolymer latex or a polyesterionomer dispersion, is preferably employed in the antistatic layer to improve the integrity of the layer and to improve adhesion to the undercoat layer. The weight ratio of polymer binder to vanadium pentoxide can range from about 1:5 to 200:1, but is preferably 1:1 to 10:1. The antistatic coating formulation may also contain a wetting aid to improve coatability. Typically, the antistat layer is coated at a dry coverage of from about 1 to 200 mg/m$^2$.

Antistatic layers described in U.S. Pat. No. 4,070,189 comprise a crosslinked vinylbenzene quaternary ammonium polymer in combination with a hydrophobic binder wherein the weight ratio of binder to antistatic crosslinked polymer is about 10:1 to 1:1.

The antistatic compositions described in U.S. Pat. Nos. 4,237,194, 4,308,332, and 4,526,706 comprise a coalesced, cationically stabilized latex and a polyaniline acid addition salt semiconductor wherein the latex and the semiconductor are chosen so that the semiconductor is associated with the latex before coalescing. Particularly preferred latex binders include cationically stabilized, coalesced, substantially linear, polyurethanes. The weight ratio of polymer latex particles to polyaniline in the antistatic coating composition can vary over a wide range. A useful range of this weight ratio is about 1:1 to 20:1. Typically, the dried coating weight of this antistatic layer is about 40 mg/m$^2$ or less.

The coating compositions utilized to form the protective overcoat layer of this invention comprise a continuous solvent medium having dispersed therein organic polymer particles. The polymer particles comprise a core portion which is insoluble (but may be swellable) in the medium and a polymeric shell portion which has affinity for both the core portion and for the continuous solvent medium. The first affinity pertains to the ability of the shell molecule to associate with the core portion physically or by covalent bond formation, whereas the second affinity refers to compatability of the shell with the continuous solvent phase. The weight of core portion to shell portion is about 90:10 to 30:70, more preferably 80:20 to 40:60, and most preferably 75:25 to 50:50. The core portion preferably has a mean particle size of from about 10 to about 500 nm, more preferably about 10 to about 200 nm, as measured at its dry state, for example, by electron microscopy.

The protective overcoat coating composition of the present invention is particularly advantageous due to its unique rheological properties and good coatability in addition to environmental considerations such as the preparation of layers at considerably less solvent loads which lead to easy drying and less solvent recovery. The resultant layers are equivalent to those coated from polymer solutions in terms of the impermeability to photographic processing solutions, layer transparency and toughness necessary for providing resistance to scratches, abrasion, blocking, and ferrotyping.

The protective overcoat composition may contain mixtures of the dispersible polymer particles described above. For example, it may be preferred in some applications to use a mixture consisting of one type of particle having a glassy core and another type of particle having a rubbery core. Such a mixture is desired for obtaining, for example, a strong (hard) and tough coating with good optical clarity. The coating composition of the present invention can also contain up to 50% by weight, preferably up to 30% by weight of solution polymer(s). The solution polymer is defined as those soluble in the desired solvent medium.

In one of the preferred embodiments of the invention, the polymer particles are composed of a core portion which is crosslinked by using about 1 to 20 parts of crosslinking agent and a shell portion which is grafted to the core portion by covalent bonding. Such particles can be made as core/shell particles by using, for example, emulsion polymerization processes. One useful technique is the so called sequential emulsion polymerization process (see, for example, Padget, J. C. in Journal of Coating Technology, Vol 66, No. 839, pages 89 to 105, 1994). In this process, the core portion is made with the use of di/trifunctional and grafting comonomers, and the shell portion is made by conducting the polymerization in a monomer starved manner so that the monomer swelling of the core particles is limited. The use of grafting comonomers in the core ensures the formation of sufficient covalent bonds between shell and crosslinked core polymers. The resultant core/shell particles can be isolated by conventional techniques and redispersed in appropriate solvent media.

When the dispersible particles of the present invention are made by sequential polymerization processes, the system is preferably designed such that the desired particle morphology exhibits low total interfacial free energy. This, however, cannot always be the case, as exemplified, for example, by dispersible particles consisting of a highly carboxylated core portion and a much less carboxylated and less hydrophilic shell portion. The overall step in the particle formation process with the desired morphology is thermodynamically unfavorable because the core portion is significantly more hydrophilic than the shell portion. In such cases, techniques by Vanderhoff, Park, and El-Aasser (ACS Symposium Series, 492, 272, 1992), and Lee and Rudin (J. Polym. Sci. Polym. Chem. Ed. 30, 2211, 1992) may be used. For example, the shell portion can be prepared by second stage polymerization at low temperature so that the mobility can be substantially reduced and thermodynamically unfavorable structures obtained.

The dispersible particles of the present invention can also be prepared by an inverted core/shell polymerization process, in which the shell portion is prepared first, followed by polymerization of the core monomer in the presence of the shell materials; by attaching preformed shell polymers to the preformed core portion; by grafting polymerization of shell monomers on the core surface, and by dispersing the core polymers in the presence of shell polymers which have affinity for both the core polymers and the solvent medium.

Ethylenically unsaturated monomers which may be used in the core portion of the polymer particles of the present invention include acrylic monomers, such as acrylic acid, or methacrylic acid, and their alkyl esters such as methyl methacrylate, ethyl methacrylate., butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, and the nitriles and amides of the same acids such as acrylonitrile, methacrylonitrile, acrylamide and methacrylamide. Other monomers which may be used, either alone or in admixture with these acrylic monomers, include vinyl acetate, vinyl propionate, vinylidene chloride, vinyl chloride, and vinyl aromatic compounds such as styrene, t-butyl styrene and vinyl toluene. Other comonomers which may be used in conjunction with any of the foregoing monomers include dialkyl maleates, dialkyl itaconates, dialkyl methylene-malonates, isoprene, and butadiene.

Preferred crosslinking and grafting comonomers which may be used, in order to effect crosslinking of the core portion of the polymer particles and grafting of the shell portion to the core portion, are monomers which are polyfunctional with respect to the polymerization reaction, including esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate, dienes such as butadiene and isoprene, esters of saturated glycols or diols with unsaturated monocarboxylic acids, such as ethylene glycol diacrylate, ethylene glycol dimethacrylate, triethylene glycol dimethacrylate, 1,4 -butanediol dimethacrylate, 1,3-butanediol dimethacrylate, and polyfunctional aromatic compounds such as divinyl benzene.

The core portion of the dispersible particles in the present invention can be made in the presence of a certain amount of pre-polymers, or functionalized oligomers, or macromonomers, which may include, for example, functionalized organosiloxanes prepared by reactions between organohydrosiloxane and multifunctional unsaturated monomers, fluorine-containing prepolymers, polyester urethanes, polyether urethanes, polyacrylourethanes, and the like.

The core portion of the dispersible particles in the present invention can be rubbery or glassy at room temperature, that is, the glass transition temperature of the core portion can be higher or lower than room temperature. The core portion can contain one phase or two or more incompatible phases. The incompatibility may be determined in various ways known in the art. The use of scanning electron microscopy using staining techniques to emphasize the differences between the appearance of the phases, for example, is such a technique.

The shell portion of the dispersible particle in the present invention may include any polymers which have affinity with both the core portion of the particle and the solvent medium. The role of such polymers is to keep the particles apart so that the attraction force between the particles becomes insignificant and the stability of the dispersion is retained during storage and under shear (see, for example, Sato T. in Journal of Coating Technology, Vol. 65, No. 825, pages 113 to 121, 1993). The types of polymers that can be used include both homopolymers and copolymers. The copolymers can be random, graft or block copolymers. The shell polymers can be physically attached to the core portion or be chemically attached to the core portion by post polymerization reactions. For example, carboxylic acid groups may be introduced to the core portion through polymerization, and epoxy group-containing monomers may be introduced to the shell portion. The shell polymers are attached to the core portion by ring opening reaction of epoxy groups with carboxylic acid groups. The shell portion can also be introduced by the aforementioned sequential emulsion polymerization process with ethylenically unsaturated monomers. Such monomers may include acrylates including acrylic acid, methacrylates including methacrylic acid, acrylamide and methacrylamide, itaconic acid and its half esters and diesters, styrene including substituted styrenes, acrylonitrile and methacrylonitrile, vinyl acetate, vinyl and vinylidene halides.

The shell polymer of the present invention is properly designed to have good compatibility in the solvent medium. Defining compatibility of the shell molecules in the solvent medium can be achieved by using the concept of "polymer solubility map" (see. for example, Ramsbotham, J, in Progress in Organic Coatings, Vol 8, Pages 113–141, 1980, and Wicks, Jr. Z. W., Jones, F. N, and Papas, S. P. in Organic Coatings, pages 229–239, 1992, John Wiley & Sons, Inc.). As the organic solvent, any of the solvents customarily used in coating compositions may be satisfactorily used. However, the preferred solvents for the practice of the present invention may include alcohols, esters, ketones, aromatic hydrocarbons, chlorinated solvents, glycols, and their mixtures.

The shell portion of the particles in the present invention may include reactive functional groups capable of forming covalent bonds by intermolecular crosslinking or by reaction with a crosslinking agent. Suitable reactive functional groups include: hydroxyl, carboxyl, carbodiimide, epoxide, aziridine, vinyl sulfone, sulfinic acid, active methylene, amino, amide, allyl, and the like.

The protective overcoat composition in accordance with the invention may also contain suitable crosslinking agents that may effectively be used in the coating compositions of the invention including aldehydes, epoxy compounds, polyfunctional aziridines, vinyl sulfones, methoxyalkyl melamines, triazines, polyisocyanates, dioxane derivatives such as dihydroxydioxane, carbodiimides, and the like. The crosslinking agents may react with functional groups present on the dispersible polymer particle, and/or the solution polymer present in the coating composition.

Matte particles well known in the art may also be used in the protective overcoat composition of the invention, such matting agents having been described in Research Disclosure No. 308, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include: hydroxyl, carboxyl, carbodiimide, epoxide, aziridine, vinyl sulfone, sulfinic acid, active methylene, amino, amide, allyl, and the like.

The protective overcoat composition of the present invention may also include lubricants or combinations of lubricants to reduce sliding friction of the imaging elements in accordance with the invention. Typical lubricants include (1) silicone based materials disclosed, for example, in U.S. Pat. Nos. 3,489,567, 3,080,317, 3,042,522, 4,004,927, and 4,047,958, and in British Pat. Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc disclosed in U.S. Pat. Nos. 2,454,043, 2,732,305, 2,976,148, 3,206,311, 3,933,516, 2,588,765, 3,121,060, 3,502,473, 3,042,222, and 4,427,964, in British Pat. Nos. 1,263,722, 1,198,387, 1,430,997, 1,466, 304, 1,320,757, 1,320,565, and 1,320,756, and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly(tetrafluoroethlyene), poly(trifluorochloroethylene), poly(vinylidene fluoride, poly(trifluorochloroethylene-co-vinyl chloride), poly(meth)acrylates, poly(itaconates), or poly(meth)acrylamides containing perfluoroalkyl side groups, and the like. Lubricants useful in the present invention are described in further detail in Research Disclosure No. 308, published December 1989, page 1006.

The protective overcoat compositions of the present invention may be applied as solvent coating formulations containing up to 20% total solids by coating methods well known in the art. For example, hopper coating, gravure coating, skim pan/air knife coating, spray coating, and other methods may be used with very satisfactory results. The coatings are dried at temperatures up to 150° C. to give dry coating weights of 20 mg/m$^2$ to 10 g/m$^2$.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in *Research Disclosure,* Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure,* Item 36544, September, 1994, and the references listed therein.

The photographic silver halide emulsions utilized in this invention can contain other addenda conventional in the photographic art. Useful addenda are described, for example, in *Research Disclosure,* Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and, UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The following examples are intended to illustrate the present invention. However, it should be understood that the invention is not limited to these illustrative examples.

The examples demonstrate the benefits of coating compositions comprising dispersible polymer particles of the present invention, and in particular show that the coating compositions of the invention have excellent stability against phase separation and flocculation, superior rheological properties for coating at lower wet coverages for high dry coating weight, good optical clarity, good barrier properties, and excellent abrasion resistance.

PREPARATIVE EXAMPLES 1–6

Preparative examples 1–6 describe the synthesis of core/shell polymer particles which are dispersible in organic media to form coating compositions useful in this invention.

A stirred reactor containing 714.3 g of deionized water and 2.7 g of sodium lauryl sulfate was heated to 80° C. and purged with $N_2$ for 1 hour. After addition of 0.788 g of potassium persulfate, an emulsion containing 130.3 g of deionized water, 153 g of methyl methacrylate, 18 g of ethylene glycol dimethacrylate, 9 g of allyl methacrylate, and 0.25 g of potassium persulfate was slowly added over a period of 1 hour. The reaction was allowed to continue for an additional 2 hours. 0.35 g of benzoyl peroxide in 5 g of toluene was then added to the reactor. An emulsion containing 326.4 g of deionized water, 3.6 g of sodium lauryl sulfate, 108 g of ethyl acrylate, 12 g of methacrylic acid, and 0.15 g of benzoyl peroxide was added continuously for 1 hour. The reaction was allowed to continue for 3 more hours before the reactor was cooled down to room temperature. The latex prepared was filtered through glass fibre to remove any coagulum.

The latex described above was mixed with acetone at 1:1 ratio to isolate the polymer particles. The precipitate was washed several times with distilled water to remove any residual surfactants and salts. Final drying was in an oven heated to 50° C. The particles prepared contained about 60% core portion and 40% shell portion. The core contained about 85% methyl methacrylate (MMA), 10% ethylene glycol dimethacrylate (EGD), and 5% allyl methacrylate (AM). The shell contained about 90% ethyl acrylate (EA) and 10% methacrylic acid (MA). The resultant polymer particles are designated as p-1.

Polymer particles p-2 to p-6 were prepared in a similar manner. Their compositions and other parameters are listed in Table 1.

TABLE 1

| Example | Particle | Core/Shell | Dia (nm) | Core Composition | Shell Composition |
|---|---|---|---|---|---|
| 1 | p-1 | 60/40 | 46 | MMA:EGD:AM = 85:10:5 | EA:MA = 90/10 |
| 2 | p-2 | 70/30 | 38 | MMA:EGD:AM = 85:10:5 | MMA:MA = 90/10 |
| 3 | p-3 | 67/33 | 49 | MMA:EGD:AM = 90:5:5 | MMA = 100 |
| 4 | p-4 | 67/33 | 48 | EA:EGD:AM = 90:5:5 | MMA = 100 |
| 5 | p-5 | 67/33 | — | MMA:EGD:AM = 90:5:5 | EA = 100 |
| 6 | p-6 | 65/35 | — | MMA:EGD:AM = 85:10:5 | MMA:MA = 65/35 |

PREPARATIVE EXAMPLES 7–25

Preparative examples 7–25 describe solvent selection for the formulation of dispersions comprised of core/shell polymer particles dispersed in organic media.

The polymer particles isolated in Preparative examples 2 and 4 were tested for their dispersibility in some common solvents used in forming useful layers for photographic materials. The dispersions were made at room temperature at 1% solids. The quality of the dispersions and their stability were assessed by visual appearance. The particles of the present invention are readily dispersible in a range of solvents with very good stability. Table 2 lists examples of solvents which can be used for dispersing p-2 and p-4 particles.

TABLE 2

| Dispersions | Solvent system | p-2 particle dispersion | p-2 particle stability | p-4 particle dispersion | p-4 particle stability |
|---|---|---|---|---|---|
| Example 7 | diacetone alcohol | y* | good | y | good |
| Example 8 | 60/40 methanol/toluene | y | good | y | good |
| Example 9 | 80/20 MEK**/ethylene glycol | y | good | y | good |
| Example 10 | 90/10 butyrolactone/methanol | y | good | y | good |
| Example 11 | 60/40 toluene/methanol | y | good | y | good |
| Example 12 | 60/40 toluene/cyclohexanol | y | good | y | good |
| Example 13 | MEK | y | good | y | good |
| Example 14 | 25/75 methylene chloride/ butyrolactone | y | good | y | good |
| Example 15 | 25/75 methylene chloride dioxane | y | good | y | good |
| Example 16 | 60/40 cyclohexanol/toluene | y | good | n*** | — |
| Example 17 | 70/30 butyrolactone ethylene glycol | y | good | n | — |
| Example 18 | 80/20 toluene/cyclohexanol | y | good | y | good |
| Example 19 | 60/40 THF****/MEK | y | good | y | good |
| Example 20 | toluene | n | — | y | good |
| Example 21 | methylene chloride | n | — | y | good |
| Example 22 | 50/50 acetone/methanol | y | good | n | — |
| Example 23 | 60/40 methylene chloride dioxane | y | good | y | good |
| Example 24 | 60/40 methylene chloride butyrolactone | y | good | y | good |
| Example 25 | 70/30 THF/cyclohexane | y | good | y | good |

*y = dispersible
**MEK = methyl ethyl ketone
***n = non-dispersible
****THF = tetrahydrofuran

PREPARATIVE EXAMPLES 26–39 AND COMPARATIVE SAMPLE A:

Preparative examples 26–39 relate to viscosity measurements for polymer particle dispersions useful in this invention while Comparative Sample A relates to viscosity measurement for a solution polymer.

The viscosity of the particle dispersions was measured by a Brookfield Viscometer at 23° C. and compared to that of Elvacite 2041 (methyl methacrylate polymer sold by E. I. DuPont de Nemours and Co.) in methylene chloride. The concentration of the particles in the various solvents used was 10 vol %. The data are listed in Table 3.

TABLE 3

| Dispersions | polymer particles | solvent | viscosity (cps) |
|---|---|---|---|
| Sample A | Elvacite 2041 | methylene chloride | 47.5 |
| Example 26 | p-3 | acetone | 2.63 |
| Example 27 | p-3 | MEK | 4.13 |
| Example 28 | p-3 | toluene | 15.4 |
| Example 29 | p-3 | methylene chloride | 20 |
| Example 30 | p-4 | acetone | 1.09 |
| Example 31 | p-4 | MEK | 1.71 |
| Example 32 | p-4 | toluene | 3.20 |
| Example 33 | p-4 | methylene chloride | 7.0 |
| Example 34 | p-5 | acetone | 1.38 |
| Example 35 | p-5 | MEK | 2.05 |
| Example 36 | p-5 | toluene | 3.90 |
| Example 37 | p-5 | methylene chloride | 6.72 |
| Example 38 | p-5 | acetone/methanol 50/50 | 1.37 |
| Example 39 | p-5 | acetone/ethanol 50/50 | 1.34 |

These examples demonstrate that the coating compositions comprising non-aqueous dispersible particles have much lower viscosity compared to those comprising solution polymers. These low viscosity coating compositions are excellent for coating delivery, coating filtration, coating application and drying, and organic solvent waste recovery.

INVENTION EXAMPLES 40–55 AND COMPARATIVE SAMPLES B–F:

Examples 40–55 illustrate the resistivity of imaging elements within the scope of the present invention. Comparative Samples B–F relate to similar imaging elements in which the protective overcoat was prepared from a solution polymer.

The following examples show that the coating compositions of the present invention provide void-free, impermeable films that are comparable with layers applied using soluble polymers. A polyethylene terephthalate film support that had been subbed with a terpolymer latex of vinylidene chloride, methyl acrylate, and itaconic acid was coated with an aqueous antistatic formulation comprising 0.025 weight % of silver-doped vanadium pentoxide, 0.075 weight % of a terpolymer latex of methylacrylate, vinylidene chloride, and itaconic acid (15/83/2) and dried at 100° C. to yield an antistatic layer having a dry weight of about 8 mg/m$^2$. Coating compositions of the invention containing 2, 4, 5, and 10% solids in different organic solvents were applied over the antistatic layer and dried for one minute at 100° C. to yield transparent coatings having a dry weight of 500 to 1000 mg/m$^2$. It is known (described in U.S. Pat. Nos. 5,006,451 and 5,221,598) that the antistatic properties of the vanadium pentoxide layer are destroyed after photographic processing if not protected by an impermeable barrier. Thus the permeability of the example coatings can be evaluated by measuring the antistatic properties of the elements after processing in conventional photographic developing and fixing solutions.

The elements were soaked in high pH (11.3) developing and fixing solutions as described in U.S. Pat. No. 4,269,929, at 38° C. for 60 seconds each and then rinsed in distilled water. The internal resistivity (using the salt bridge method, described in R. A. Elder, "Resistivity Measurements on Buried Conductive Layers", EOS/ESD Symposium Proceedings, September 1990, pages 251–254.) of the processed elements at 20% relative humidity was measured and compared with the internal resistivity before processing. The coating compositions and results are reported in Table 4. This table demonstrates that the coating compositions for examples 40–55 of the present invention have permanency of the antistatic properties comparable to those obtained from samples B–F which are polymer solution applied protective overcoats (Elvacite 2041 and 2009).

TABLE 4

| Coatings | Description | Solvent | Resistivity Before Process log Ω/□ | Resistivity After Process log Ω/□ |
|---|---|---|---|---|
| Sample B | Elvacite 2041, 500 mg/m$^2$ | methylene chloride | 7.1 | 6.9 |
| Sample C | Elvacite 2041, 1000 mg/m$^2$ | methylene chloride | 7.1 | 7.2 |
| Sample D | Elvacite 2041, 1000 mg/m$^2$ | acetone | 7.5 | 7.5 |
| Sample E | Elvacite 2041, 1000 mg/m$^2$ | methyl ethyl ketone | 7.5 | 7.5 |
| Sample F | Elvacite 2009*, 800 mg/m$^2$ | acetone/methanol 89/11 | 7.1 | 7.1 |
| Example 40 | p-3, 500 mg/m$^2$ | methylene chloride | 7.1 | 6.8 |
| Example 41 | p-3, 1000 mg/m$^2$ | methylene chloride | 7.2 | 7.2 |
| Example 42 | p-3/Elvacite 2041 70/30 500 mg/m$^2$ | methylene chloride | 7.1 | 7.2 |
| Example 43 | p-3/Elvacite 2041 70/30 1000 mg/m$^2$ | methylene chloride | 7.2 | 6.9 |
| Example 44 | p-3, 1000 mg/m$^2$ | acetone | 7.8 | 7.2 |
| Example 45 | p-3, 800 mg/m$^2$ | acetone/methanol 89/11 | 6.9 | 6.8 |
| Example 46 | p-3/nitrocellulose** 70/30 800 mg/m$^2$ | acetone/methanol 89/11 | 7.0 | 6.9 |
| Example 47 | p-4, 1000 mg/m$^2$ | acetone | 7.5 | 7.4 |
| Example 48 | p-4/Elvacite 2041 75/25 1000 mg/m$^2$ | methyl ethyl ketone | 7.7 | 7.5 |
| Example 49 | p-5, 1000 mg/m$^2$ | methylene chloride | 7.1 | 6.8 |
| Example 50 | p-5, 1000 mg/m$^2$ | acetone/ethanol 50/50 | 7.1 | 6.8 |
| Example 51 | p-5, 1000 mg/m$^2$ | acetone/methanol 50/50 | 7.1 | 6.7 |
| Example 52 | p-5, 1000 mg/m$^2$ | acetone | 7.8 | 7.2 |
| Example 53 | p-4/Elvacite 2041 50/50 1000 mg/m$^2$ | acetone | 7.8 | 7.8 |
| Example 54 | p-4/Elvacite 2041 75/25 1000 mg/m$^2$ | acetone | 7.8 | 7.6 |
| Example 55 | p-2/PFAZ322***, 800 mg/m$^2$ | acetone/methanol 89/11 | 7.1 | 7.1 |

*Elvacite 2009: methyl methacrylate polymer sold by E. I. DuPont de Nemours and Co.
**Nitrocellulose: R.S. ½ seconds
***PFAZ322: polyfunctional aziridine, (Sybron Chemicals Inc.), added at 10 wt % of solids.

EXAMPLES 56–57

Examples 56–57 illustrate elements within the scope of the present invention employing a different antistatic agent than that employed in Examples 40–55.

Subbed polyester film support was coated with a methanol/acetone antistatic formulation comprising a crosslinked vinylbenzyl quaternary ammonium polymer as described in U.S. Pat. No. 4,070,189 and polymeric binder. The antistatic layer was coated at a dry weight of 350 mg/m$^2$ and contained a 1/1 ratio of the antistatic polymer to binder polymer. Overcoat formulations of the invention were then applied from methanol/acetone onto the antistatic layer and dried as before to give transparent coatings with a dry weight of 800 mg/m$^2$. The samples were then evaluated for antistatic properties (at 50% RH) after photographic processing in an analogous manner to that described in Examples 40–55. The results are given in Table 5.

TABLE 5

| Coatings | Antistatic Layer Binder Polymer | Overcoat Description | Resistivity After Process log Ω/□ |
|---|---|---|---|
| Example 56 | nitrocellulose | p-3/nitrocellulose 70/30 | 9.6 |
| Example 57 | p-3 | p-3/nitrocellulose 70/30 | 9.5 |

EXAMPLES 58–61 AND COMPARATIVE SAMPLES G–H:

Examples 58–61 illustrate the abrasion resistance of elements within the scope of the present invention. Comparative Samples G and H relate to similar elements in which the protective overcoat was prepared from a solution polymer.

The following examples demonstrate the excellent physical properties that are obtained with the coating compositions of the present invention. Antistatic coatings comprising vanadium pentoxide were applied onto a moving web of polyethylene terephthalate film support that had been subbed with a terpolymer latex of vinylidene chloride, methyl acrylate, and itaconic acid and dried at 105° C. to give a dried coating weight for the antistatic layer of 8 mg/m$^2$. Coating formulations in methylene chloride comprising 1.25 to 4.0 wt % total solids were applied onto the antistatic layer to give transparent films with a dry coating weight of 650 and 1300 mg/m$^2$. Taber abrasion values for the coatings were measured and compared with those for Elvacite 2041 coated from methylene chloride solutions at dry coating weights of 650 and 1300 mg/m$^2$, respectively. The Taber abrasion tests were performed in accordance with the procedures set forth in ASTM D1044. The results are given in Table 6.

TABLE 6

| Coating | Description | Taber Abrasion (% haze) |
|---|---|---|
| Sample G | Elvacite 2041 650 mg/m$^2$ | 12.2 |
| Sample H | Elvacite 2041 1300 mg/m$^2$ | 10.7 |
| Example 58 | p-4 650 mg/m$^2$ | 11.0 |
| Example 59 | p-4 1300 mg/m$^2$ | 10.6 |
| Example 60 | p-4/Elvacite 2041 70/30 650 mg/m$^2$ | 10.3 |
| Example 61 | p-4/Elvacite 2041 70/30 1300 mg/m$^2$ | 9.6 |

As shown by the above examples, the coating compositions employed in this invention, namely compositions comprising a liquid organic medium as a continuous phase and core/shell polymer particles as a disperse phase, are capable of forming a continuous film under rapid drying conditions such as are typically employed in the manufacture of imaging elements. Protective overcoat layers formed in this manner combine a number of highly advantageous features, including good optical clarity, good barrier properties, and excellent abrasion resistance.

The invention has been described in detail, with particular reference to certain preferred embodiments thereof, but it should be understood that variations and modifications can be effected within the spirit and scope of the invention.

We claim:

1. An imaging element for use in an image-forming process; said imaging element comprising a support, an image-forming layer, an electrically-conductive layer and a protective overcoat layer that overlies said electrically-conductive layer; said protective overcoat layer having been coated from a dispersion of polymer particles in a liquid organic medium; said polymer particles comprising a core portion which is insoluble in said organic medium and a shell portion which has an affinity for both said core portion and said organic medium.

2. An imaging element as claimed in claim 1, wherein said element is a photographic element.

3. An imaging element as claimed in claim 1, wherein said support is an acetate film support.

4. An imaging element as claimed in claim 1, wherein said support is a polyester film support.

5. An imaging element as claimed in claim 1, wherein said image-forming layer is a silver halide emulsion layer.

6. An imaging element as claimed in claim 1, wherein said image-forming layer is a thermally-processable imaging layer.

7. An imaging element as claimed in claim 1, wherein said electrically-conductive layer is an antistatic layer.

8. An imaging element as claimed in claim 1, wherein said electrically-conductive layer comprises vanadium pentoxide as an electrically-conductive agent.

9. An imaging element as claimed in claim 1, wherein said electrically-conductive layer comprises a crosslinked vinylbenzene quaternary ammonium polymer as an electrically-conductive agent.

10. An imaging element as claimed in claim 1, wherein said electrically-conductive layer comprises a coalesced cationically stabilized latex and a polyaniline acid addition salt semiconductor.

11. An imaging element as claimed in claim 1, wherein the weight ratio of the core portion to the shell portion of said polymer particles is 75:25 to 50:50.

12. An imaging element as claimed in claim 1, wherein the core portion of said polymer particles has a mean particle size of about 10 to about 200 nm.

13. An imaging element as claimed in claim 1, wherein said protective overcoat layer comprises a mixture of polymer particles having a glassy core and polymer particles having a rubbery core.

14. An imaging element as claimed in claim 1, wherein said dispersion of polymer particles contains up to 50 percent by weight of solution polymer.

15. An imaging element as claimed in claim 1, wherein said polymer particles are composed of a core portion which is crosslinked by a crosslinking agent and a shell portion which is grafted to said core portion by covalent bonding.

16. An imaging element as claimed in claim 1, wherein said core portion of said polymer particles is formed from a crosslinked polymer of at least one ethylenically-unsaturated monomer.

17. An imaging element as claimed in claim 1, wherein said shell portion of said polymer particles is formed from at least one acrylic monomer.

18. An imaging element as claimed in claim 1, wherein said shell portion of said polymer particles is formed from at least one monomer which contains hydrophilic functionality.

19. An imaging element as claimed in claim 1, wherein said shell portion of said polymer particles is formed from at least one monomer which contains carboxylic acid groups.

20. An imaging element as claimed in claim 1, wherein said dispersion includes a crosslinking agent.

21. An imaging element as claimed in claim 1, wherein said liquid organic medium is selected from the group consisting of alcohols, esters, ketones, aromatic hydrocarbons, chlorinated solvents, glycols and mixtures thereof.

22. An imaging element as claimed in claim 1, wherein said protective overcoat layer additionally comprises matte particles and a lubricant.

23. An imaging element as claimed in claim 1, wherein said core portion of said polymer particles is comprised of an interpolymer of methyl methacrylate, ethylene glycol dimethacrylate and allyl methacrylate and said shell portion of said polymer particles is comprised of a copolymer of ethyl acrylate and methacrylic acid.

24. An imaging element as claimed in claim 1, wherein said core portion of said polymer particles is comprised of an interpolymer of ethyl acrylate, ethylene glycol dimethacrylate and allyl methacrylate and said shell portion of said polymer particles is comprised of a homopolymer of methyl methacrylate.

* * * * *